US006944977B2

(12) United States Patent
Deniau et al.

(10) Patent No.: US 6,944,977 B2
(45) Date of Patent: Sep. 20, 2005

(54) DRUM FOR AN EXCAVATOR THAT CAN BE USED IN PARTICULAR FOR THE PRODUCTION OF VERTICAL TRENCHES IN HARD OR VERY HARD SOILS

(75) Inventors: Alain Deniau, Nanterre (FR); Fabrice Mathieu, Nanterre (FR)

(73) Assignee: Compagnie Du Sol, Nanterre (FR)

( * ) Notice: Subject to any disclaimer, the term of this patent is extended or adjusted under 35 U.S.C. 154(b) by 0 days.

(21) Appl. No.: 10/750,305

(22) Filed: Dec. 31, 2003

(65) Prior Publication Data

US 2004/0172857 A1 Sep. 9, 2004

(30) Foreign Application Priority Data

Jan. 8, 2003 (FR) ..... 03 00126

(51) Int. Cl.[7] ..... E02F 5/08

(52) U.S. Cl. ..... 37/94; 37/189; 299/85.1; 299/110; 175/355

(58) Field of Search ..... 299/85.1, 79.1, 299/77, 78, 110, 73, 86, 85, 88, 89, 10; 37/94, 189, 190, 337, 452, 462; 175/81, 94, 355, 122, 364, 373; 173/32, 3.6

(56) References Cited

U.S. PATENT DOCUMENTS

| | | | | |
|---|---|---|---|---|
| 3,050,292 A | * | 8/1962 | Newton et al. | 299/110 |
| 3,545,811 A | | 12/1970 | Montacle | |
| 3,999,616 A | * | 12/1976 | Crane et al. | 173/32 |
| 4,009,909 A | * | 3/1977 | Robbins et al. | 299/56 |
| 4,371,210 A | | 2/1983 | Leibee | |
| 4,548,442 A | * | 10/1985 | Sugden et al. | 299/10 |
| 5,035,071 A | * | 7/1991 | Stotzer et al. | 37/94 |
| 5,234,257 A | * | 8/1993 | Sugden et al. | 299/10 |
| 5,295,735 A | | 3/1994 | Cobbs et al. | |
| 5,308,151 A | * | 5/1994 | Sugden et al. | 299/73 |
| 5,924,222 A | | 7/1999 | Stoetzer | |
| 5,964,305 A | * | 10/1999 | Arzberger et al. | 175/91 |

FOREIGN PATENT DOCUMENTS

| | | |
|---|---|---|
| DE | 39 33 168 | 4/1990 |
| EP | 1 231 327 | 8/2002 |
| FR | 1 445 627 | 10/1966 |
| FR | 1 545 629 | 11/1968 |

* cited by examiner

*Primary Examiner*—Thomas B. Will
*Assistant Examiner*—Thomas A Beach
(74) *Attorney, Agent, or Firm*—Merchant & Gould P.C.

(57) ABSTRACT

Excavator drum for the production of vertical trenches, including a cylindrical shell (22) mounted so sa to rotate about its axis of revolution and a plurality of excavating tools (28, 30) mounted on the external face of the shell. The tools include a plurality of first rollers (36) equipped with cutting elements (38) mounted so as to rotate about axes, the mid-plane of the rollers substantially merging with the mid-plane (P–P') of the shell, and the length of which is less the an the length of the shell; and a plurality of pairs of second rollers (50, 52) equipped with cutting elements, the rollers of the same pair being mounted so as to rotate about cantilever axles (54, 56) each roller having a length at least equal to the distance that separates one end a first roller from the corresponding end of the shell, the casing of the external end of the second rollers being at least in the plane containing one end (32, 34) of the shell.

12 Claims, 2 Drawing Sheets

DRUM FOR AN EXCAVATOR THAT CAN BE USED IN PARTICULAR FOR THE PRODUCTION OF VERTICAL TRENCHES IN HARD OR VERY HARD SOILS

FIELD OF THE INVENTION

The subject of the present invention is a drum for an excavator that can be used in particular for the production of vertical trenches in hard or very hard soils.

BACKGROUND OF THE INVENTION

To produce vertical trenches that can have a large depth, typically at least 15 metres, it is known to use drilling machines usually called excavators, themselves being of well-known type. Such drilling rigs are described in particular in European Patent Application No. 1 231 327 filed in the name of the Applicant. These rigs essentially consist of a frame suspended from the lower end of a pulley block. The frame of the excavator is equipped at its lower end with two pairs of excavator drums each driven by a motor, preferably a hydraulic motor. Depending on the nature of the ground to be dug, excavating tools of different types are fastened to the shell of the excavator drum.

When it is desired to produce the trench in a hard or very hard soil, the excavating tools often consist of rollers or cutting wheels mounted so as to rotate freely on the periphery of the shell of the drum. These rollers are equipped with studs which enable the hard soil to be perforated and thus the drilling to be carried out. However, mounting the excavating tools on the shell of the drum in this case raises difficulties.

These difficulties will emerge more clearly with reference to FIG. 1, appended hereto. Represented in this figure is the central core 12 of the excavator that constitutes the lower end of the excavator frame. Mounted on this core are two excavator drums 14 and 16 that are represented by their trench in FIG. 1. Each drum, or more accurately each drum shell 14*a*, 16*a*, has a certain width l along the direction of the rotation X–X' axis of the drums. To produce the vertical trench, it is necessary that the excavating tools mounted on the shells enable drilling over a width L at least equal to the width l of the shells. However, when it is required to drill into a hard or very hard soil, mounting the rollers or cutting wheels constituting the excavating tools raises considerable difficulties on account of the very large forces that have to be absorbed by the rollers and therefore in particular by the bearings and the axles on which these rollers are rotationally mounted.

To attempt to solve this problem, U.S. Pat. No. 5,924,222 has described excavator drums which consist of cylindrical shells on which are mounted frustoconical rollers that are angularly offset in relation to the shells and have, towards the external faces of the shell, a rotation axis inclined sufficiently to enable the axles of the rollers to be mounted on two end bearings. This enables the very large mechanical forces applied to the axles and to the bearings to be absorbed. By virtue of the high degree of inclination of these axles, it is necessary that the rollers have a high degree of conicity.

However, this solution, which consists in using highly frustoconical rollers steeply inclined with respect to the mid-plane of the shells, does not enable a high efficiency of the excavating tools to be obtained.

One object of the present invention is to provide an excavator drum which effectively enables the trench to be excavated over the total width of the shells of the excavator drums while at the same time making it possible to obtain a much greater efficiency of the tool than is obtained by the technique described above.

SUMMARY OF THE INVENTION

To achieve this aim, according to the invention an excavator drum for the production of vertical trenches, comprising a cylindrical shell mounted so as to rotate about its axis of revolution and having end faces and a plurality of excavating tools mounted on the external face of the said shell is characterized in that the said tools comprise:

- a plurality of first rollers mounted so as to rotate about axes making an angle of less than 45 degrees with the rotation axis of the drum, the external wall of which is a surface of revolution that is symmetrical with respect to the mid-plane of the roller orthogonal to its rotation axis, the said mid-plane substantially merging with the mid-plane of the shell, the said external wall, the length of which is less than the length of the shell, being equipped with cutting elements; and
- a plurality of pairs of second rollers, the rollers of the same pair being mounted so as to rotate about cantilever axles whose support is mounted on the central area of the shell, the said axles making an angle of less than 30 degrees with the axis of the shell, each roller having a length at least equal to the distance that separates one end of a first roller from the corresponding end of the shell, the casing of the external end of the second rollers being at least in the plane containing one end of the shell, the pairs of second rollers being angularly offset in relation to one another and with respect to the first rollers, the external wall of each second roller being fitted with cutting elements.

It is understood that the drilling of the trench over the total width of the shell of the excavator drum is obtained by the combination of the action of the first cylindrical rollers and of the pairs of rollers mounted in the vicinity of the end faces of the shell of the drum.

As the first rollers are substantially cylindrical or have a slight barrel shape, optimum efficiency of the tool is obtained. In order to obtain drilling over the total width of the shell, something which can of course not be implemented by the first drums, the width of which is necessarily less than that of the shell, provision has been made to mount, in the vicinity of the end faces of the shells, rollers of smaller width which may be mounted in cantilever fashion in a single bearing owing to the fact that the greater part of the drilling force is obtained by the first rollers.

In a preferred method of implementation, the first rollers have axles that are mounted, at each of their ends, in bearings fixed to the external wall of the shells. This results not only in optimum drilling efficiency but also in likewise optimum mechanical resistance to the forces, owing to the presence of the bearings at the two ends of the rotation axles of these first rollers.

BRIEF DESCRIPTION OF THE DRAWINGS

Other features and advantages of the invention will become more apparent on reading the following description of several embodiments of the invention given by way of non-limiting examples. The description refers to the appended figures, in which.

DETAILED DESCRIPTION OF THE INVENTION

Figure 1:
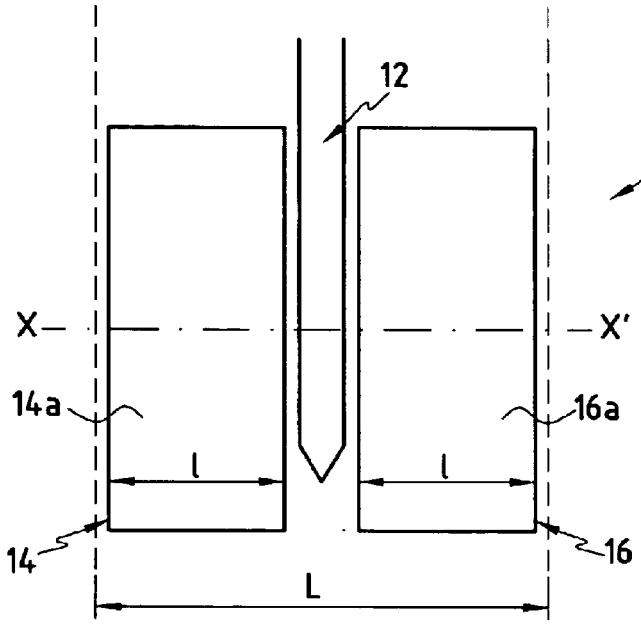
FIG. 1, already described, is a basic view illustrating the mode of action of an excavator with a drum.
Figure 2:
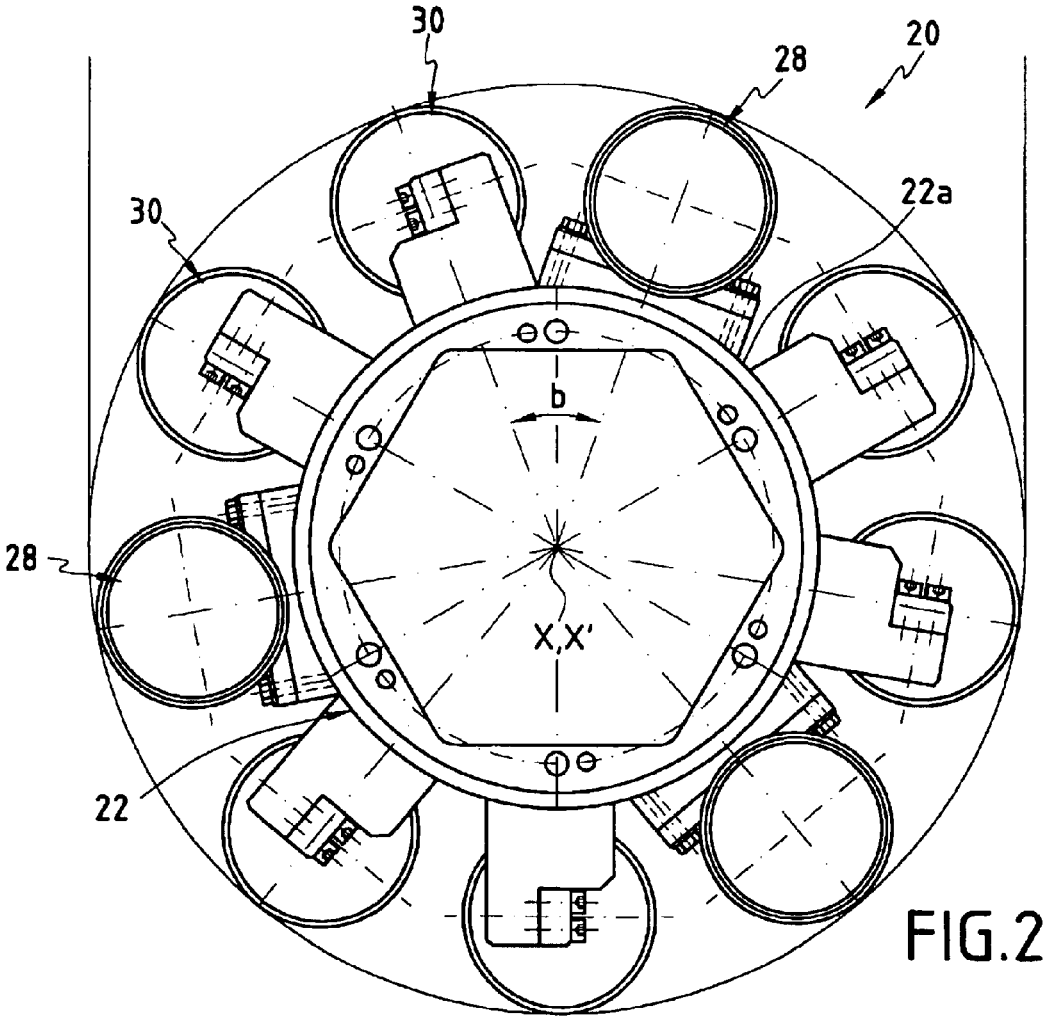
FIG. 2 is a front view of an excavator drum according to the invention.
Figure 3:
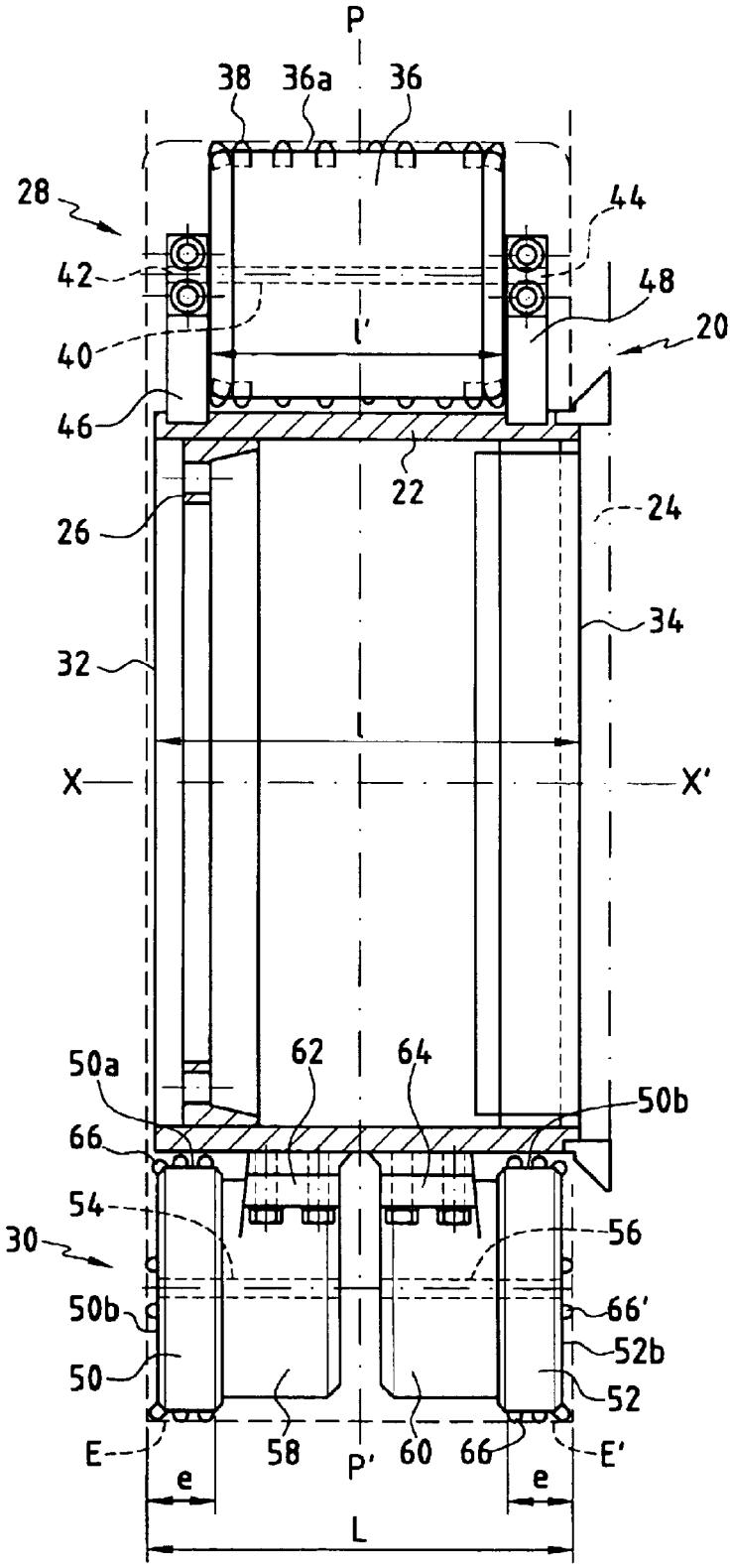
FIG. 3 is a side view of the excavator drum of FIG. 2.

With reference first of all to FIGS. 2 and 3, a description will be given of a first embodiment of the excavator drum that bears the general reference 20.

The drum 20 first of all comprises a cylindrical shell 22 that is driven in rotation about its axis of revolution X–X' by a motor (not shown) integral with the core 24 of the excavator. Mechanical components such as 26 produce the rotation transmission between the output of the drive motor and the shell 22. As these parts of the excavator are well known, it is unnecessary to describe them in detail.

Mounted on the external face 22*a* of the shell 22 are excavating tools that are of two different types. On the one hand, there are tools 28 that consist of a single roller that will be described later in more detail and, on the other hand, excavating tools 30 consisting of a pair of second excavating rollers. As shown in FIG. 2, the excavation tools 28 or 30 are angularly uniformly distributed over the shell 22 about its rotation axis X–X', making between them angles b at the centre. In the particular embodiment represented in FIG. 2, there are alternately one tool 28 then two tools 30, than one tool 28, etc. Of course, other distributions of the two types of tools could be implemented.

Referring more particularly now to FIG. 3, a more detailed description will be given of the excavating tools 28 and 30. This figure again shows the shell 22, which comprises two end faces each designated 32 and 34, the distance between these faces being the width l of the shell 32. The tool 28 consists of a roller or cutting wheel 36 whose lateral wall 36*a* is fitted with cutting elements such as studs 38. The lateral wall 36*a* of the roller may be cylindrical. It may also be a surface of revolution generated by a generatrix having the form of a curve (portion of an ellipse) that is symmetrical in relation to the mid-plane of the roller. The roller 36 is mounted so as to rotate about an axle 40 that is substantially parallel to the axis X' -X of rotation of the shell 22. The axle 40 is supported by two end bearings 42 and 44 that are fixed to the external face 22*a* of the shell by means of supports 46 and 48. On account of the presence of the bearings and of the supports, it will be understood that the active width of the roller 36 denoted by 1' is necessarily less than the width l of the shell 22. However, this width l' is greater than half the width l of the shell and, preferably, greater than ⅔ of this width. It will thus be understood that very large forces may be withstood by the roller 36 since the axle 40 on which it rotates is supported by two end bearings 42 and 44.

Preferably, the axles 40 of the rollers may not be parallel with the axis X–X' of the shell 22, but make a small angle of around 1 to 10 degrees with it in order to allow a slight displacement of the studs 38 while the roller 36 is rotating. In the case of softer ground, this angle may reach 45 degrees.

The second excavating tool 30 consists of a pair of excavating rollers or cutting wheels denoted by 50 and 52. The rollers 50 and 52 have a side wall 50*a*, 52*a* that is substantially cylindrical. Each roller 50, 52 is mounted so as to rotate about a shaft 54, 56 that is respectively mounted in cantilevered fashion on a bearing 58, 60 fixed to the external wall of the shell 22 by means of supports 62 and 64. In the embodiment represented, the rotation axles 54 and 56 are parallel to the X–X' rotation axis of the shell 22. In FIG. 3, the second rollers 50 and 52 have axles parallel to the axis X–X' of the shell. In some cases corresponding to very hard ground, it is advantageous to set the axles 54 and 56 at a slight angle of 1 to 10 degrees in order to obtain a displacement effect for the rollers.

The rollers 50 and 52 of the same pair occupy the same angular position with respect to the axis X–X' of the shell and are arranged substantially symmetrically with respect to the mid-plane P–P' of the shell, orthogonal to the axis X–X'. More precisely, during the rotation of the shell 22, the rollers 50 and 52 are arranged in such a way that the casing E and E' of these rollers extends at least as far as the end faces 32 and 34 of the shell or slightly protrudes relative to its faces. Furthermore, the width e of these rollers is such that their area of action partially overlaps with that of the first rollers 36 in such a way that, while the soil is being drilled, there is an overlap between the area drilled by the rollers 36 and that drilled by the rollers 50 and 52. However, by virtue of the large width of the rollers 36, the width l of the rollers 50 and 52 may be reduced. It is at most equal to ¼ of the width of the shell and preferably not greater than ⅙th.

It will be understood that in this way the condition that the width L actually drilled by the excavator drum is at least equal to the width l of the shell of the drum is effectively satisfied. The width of the shell may be between 25 and 75 cm. Furthermore, it will be understood that the greater part of the drilling is carried out by the rollers 36, the axles for the rotation of which are mounted in two end bearings 42 and 44. By contrast, it will be understood that the second rollers 50 and 52 have to develop only a much more limited drilling force owing to the presence of the rollers 36. That is why the rollers 50 and 52 may be mounted in a cantilevered fashion on the bearings 58 and 60. In spite of this cantilevered mounting and by virtue of the limited forces applied to these rollers, the latter can withstand the stresses that are applied to them.

The rollers 50 and 52 are equipped on their side walls 50*a* and 52*a* with studs such as 66. Studs 66' may also be provided on the external sides 50*b* and 52*b* of the rollers 50 and 52 in their peripheral part. It could also be contemplated to equip the entirety of the external end faces 50*b* and 52*b* of the rollers 50 and 52 with studs 66'.

Furthermore, the first rollers 36 may be centred with respect to the shell 22. In that case, the centre of the rotation axis of the rollers is substantially arranged in the mid-plane of the shell 22, orthogonal to the rotation axis X–X' of the latter. The first rollers 36 may also be arranged in a staggered fashion. In that case, the centres of the axes of the rollers 36 are alternately arranged on either side of the mid-plane of the shell 22, orthogonal to its rotation axis.

What is claimed is:

1. Excavator drum for the production of vertical trenches, comprising:

a cylindrical shell mounted so as to rotate about its axis of revolution and having end faces; and a plurality of excavating tools mounted on the external face of the said shell, said tools comprising:

a plurality of first rollers mounted so as to rotate about axes making an angle of less than 45 degrees with the rotation axis of the drum, the external wall of which is a surface of revolution that is symmetrical with respect to the mid-plane of the roller orthogonal to its rotation axis, the said mid-plane substantially merging with the mid-plane of the shell; the said external wall being equipped with cutting elements and defining a first roller cutting area; and the length of which is less than the length of the shell; and a plurality of pairs of second rollers, each roller of the same pair being mounted so as to rotate about a cantilever axle whose support is mounted on the central area of the shell, the axles make an angle less than 30 degrees with the axis of the shell, each roller having a width at least equal to the distance that separates one end of a first roller from the corresponding end of the shell, the casing of the external end of the second rollers being at least in the plane containing one end of the shell, the pairs of second rollers being angularly offset in relation to one another and with respect to the first rollers, the external wall of each second roller being fitted with cutting elements, said second roller external wall defining a drilling area whereby the drilling area for the pairs of second rollers partially overlaps the drilling area for the first rollers.

2. Excavator drum according to claim 1, wherein the axis of the first rollers makes an angle of between 1 and 10 degrees with the axis of the shell.

3. Excavator drum according to claim 1, wherein said second rollers make an angle of between 1 and 10 degrees with the axis of the shell.

4. Excavator drum according to claim 1, wherein said second rollers are cylindrical and their rotation axes are substantially parallel to the rotation axis of the shell.

5. Excavator drum according to claim 1, wherein the centre of the axis of the first rollers is substantially in the mid-plane of the said shell, orthogonal to its rotation axis.

6. Excavator drum according to claim 1, wherein the centre of the axis of said first rollers is alternately arranged on either side of the mid-plane of the shell orthogonal to its rotation axis.

7. Excavator drum according to claim 1, wherein the external sides of the second rollers are fitted, at least in their peripheral area, with cutting elements.

8. Excavator drum according to claim 1, wherein the rotation axis of each first roller is mounted, at each of its ends, in a bearing integral with the external wall of the shell.

9. Excavator drum according to claim 1, wherein said first rollers are cylindrical.

10. Excavator drum according to claim 1, wherein said first rollers have a barrel shape.

11. Excavator drum according to claim 1, wherein said cutting elements are studs.

12. Excavator drum according to claim 1, wherein the width of the said first rollers is at least equal to half the width of the shell.

* * * * *